US012535260B2

(12) United States Patent
Haque et al.

(10) Patent No.: US 12,535,260 B2
(45) Date of Patent: Jan. 27, 2026

(54) TRIMBREAKER LADDER COVER

(71) Applicant: Whirlpool Corporation, Benton Harbor, MI (US)

(72) Inventors: Niyaz Ul Haque, Stevensville, MI (US); Marcel Bögger Lessa, Joinville (BR); John Jay Myers, Saugatuck, MI (US); Dayabhushan Shankarrao Thorat, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 120 days.

(21) Appl. No.: 18/515,820

(22) Filed: Nov. 21, 2023

(65) Prior Publication Data

US 2025/0164175 A1 May 22, 2025

(51) Int. Cl.
*F25D 23/02* (2006.01)

(52) U.S. Cl.
CPC ..... *F25D 23/02* (2013.01)

(58) Field of Classification Search
CPC ..... F25D 23/02; F25D 23/028; F25D 23/067; F25D 23/04
See application file for complete search history.

(56) References Cited

U.S. PATENT DOCUMENTS

| | | | | |
|---|---|---|---|---|
| 2,648,584 | A | 8/1953 | Morton | |
| 4,829,653 | A * | 5/1989 | Stich | F25D 23/04 29/525.07 |
| 8,881,466 | B2 * | 11/2014 | Roberts | F25D 23/02 312/405.1 |
| 8,943,770 | B2 | 2/2015 | Sanders et al. | |
| 9,863,690 | B1 * | 1/2018 | Demiroez | F25D 23/04 |
| 9,879,900 | B1 * | 1/2018 | Ammerman | F25D 23/04 |
| 11,320,191 | B2 | 5/2022 | Kang et al. | |
| 11,493,261 | B2 | 11/2022 | Nam et al. | |
| 11,650,003 | B2 | 5/2023 | Gomes et al. | |
| 12,031,770 | B2 * | 7/2024 | Choy | F25D 23/066 |
| 2012/0293056 | A1 * | 11/2012 | Kim | F25D 23/04 312/405.1 |
| 2022/0282905 | A1 | 9/2022 | Hunter et al. | |
| 2023/0078837 | A1 * | 3/2023 | Ekshinge | F25D 23/02 52/784.15 |
| 2025/0044016 | A1 * | 2/2025 | Lessa | F25D 23/04 |
| 2025/0123050 | A1 * | 4/2025 | Lessa | A47B 96/1408 |

FOREIGN PATENT DOCUMENTS

| | | | | |
|---|---|---|---|---|
| AU | 2020200142 | B2 * | 7/2021 | F25D 13/00 |
| CN | 101889184 | A * | 11/2010 | F25D 23/04 |
| EP | 3327380 | A1 | 5/2018 | |
| EP | 2163840 | B1 * | 2/2019 | F25D 23/02 |
| JP | 2004218863 | A * | 8/2004 | F25D 23/04 |
| KR | 20190010383 | A | 1/2019 | |
| KR | 102445184 | B1 * | 9/2022 | |

* cited by examiner

*Primary Examiner* — Hanh V Tran
(74) *Attorney, Agent, or Firm* — Price Heneveld LLP

(57) ABSTRACT

A door for an appliance is disclosed. The door may include an outer panel having a generally planar body portion and an inner panel having a generally planar body portion. A trim breaker interconnects the outer panel and the inner panel to form an insulation cavity therebetween. At least one bracket assembly may be coupled to an outer surface of the inner panel, inset from the trim breaker, which may include a plurality of receiving apertures. The door may also include a trim shroud having at least one elongate slot disposed therethrough and positioned vertically therealong.

20 Claims, 11 Drawing Sheets

TRIMBREAKER LADDER COVER

BACKGROUND OF THE DISCLOSURE

The present disclosure generally relates to a door for an appliance, and more specifically, to door for a refrigerating appliance having a trim shroud.

A conventional refrigerator typically includes an outer wrapper sealed with an inner liner by a trim breaker. The space between the outer wrapper and the inner liner can be filled with an insulation material to insulate an interior of the appliance. Additionally, it is common for refrigerator doors to include a support system for supporting bin assemblies thereon.

SUMMARY OF THE DISCLOSURE

According to one aspect of the present disclosure, a door for a refrigerating appliance includes an outer panel having a generally planar body portion and an inner panel having a generally planar body portion. A trim breaker interconnects the outer panel and the inner panel to form an insulation cavity therebetween. At least one bracket assembly is coupled to an outer surface of the inner panel, inset from the trim breaker and includes a plurality of receiving apertures. A trim shroud includes at least one elongate slot disposed therethrough and positioned vertically therealong. The trim shroud is disposed over the at least one bracket assembly and a portion of the trim breaker at an interface between the trim breaker and the inner panel such that the at least one elongate slot of the trim shroud is in alignment with at least one of the plurality of receiving apertures.

According to another aspect of the present disclosure, a door assembly includes an outer panel having a generally planar body portion and an inner panel having a generally planar body portion. A trim breaker interconnects the outer panel and the inner panel to form an insulation cavity therebetween. A pair of bracket assemblies are coupled to the inner panel, inset from the trim breaker and include a plurality of receiving apertures. A trim shroud defines a pair of elongate slots therethrough. The trim shroud is positioned to conceal the pair of bracket assemblies and a portion of the trim breaker at an interface between the trim breaker and the inner panel, wherein each of the elongate slots are at least partially aligned with at least one of the plurality of receiving apertures. A strong assembly is removably coupled to the pair of bracket assemblies through the pair of elongate slots.

According to yet another aspect of the present disclosure, a refrigerating appliance includes a cabinet defining a compartment and a door that provides selective access to the compartment. The door includes an outer panel having a generally planar body portion and an inner panel having a generally planar body portion. A trim breaker interconnects the outer panel and the inner panel to form an insulation cavity therebetween. A first bracket assembly is coupled to the inner panel, inset from the trim breaker and includes a first plurality of receiving apertures. A second bracket assembly is coupled to the inner panel, inset from the trim breaker and includes a second plurality of receiving apertures. A trim shroud includes a first sidewall, a second sidewall parallel to the first sidewall, and a fascia joining the first sidewall and the second sidewall. The fascia defines a first slot and a second slot therethrough. The trim shroud is disposed over the first and second bracket assemblies and a portion of the trim breaker at an interface between the trim breaker and the inner panel such that each of the first and second slots are at least partially aligned with at least one of the first and second plurality of receiving apertures, respectively.

These and other features, advantages, and objects of the present disclosure will be further understood and appreciated by those skilled in the art by reference to the following specification, claims, and appended drawings.

Figure 1:
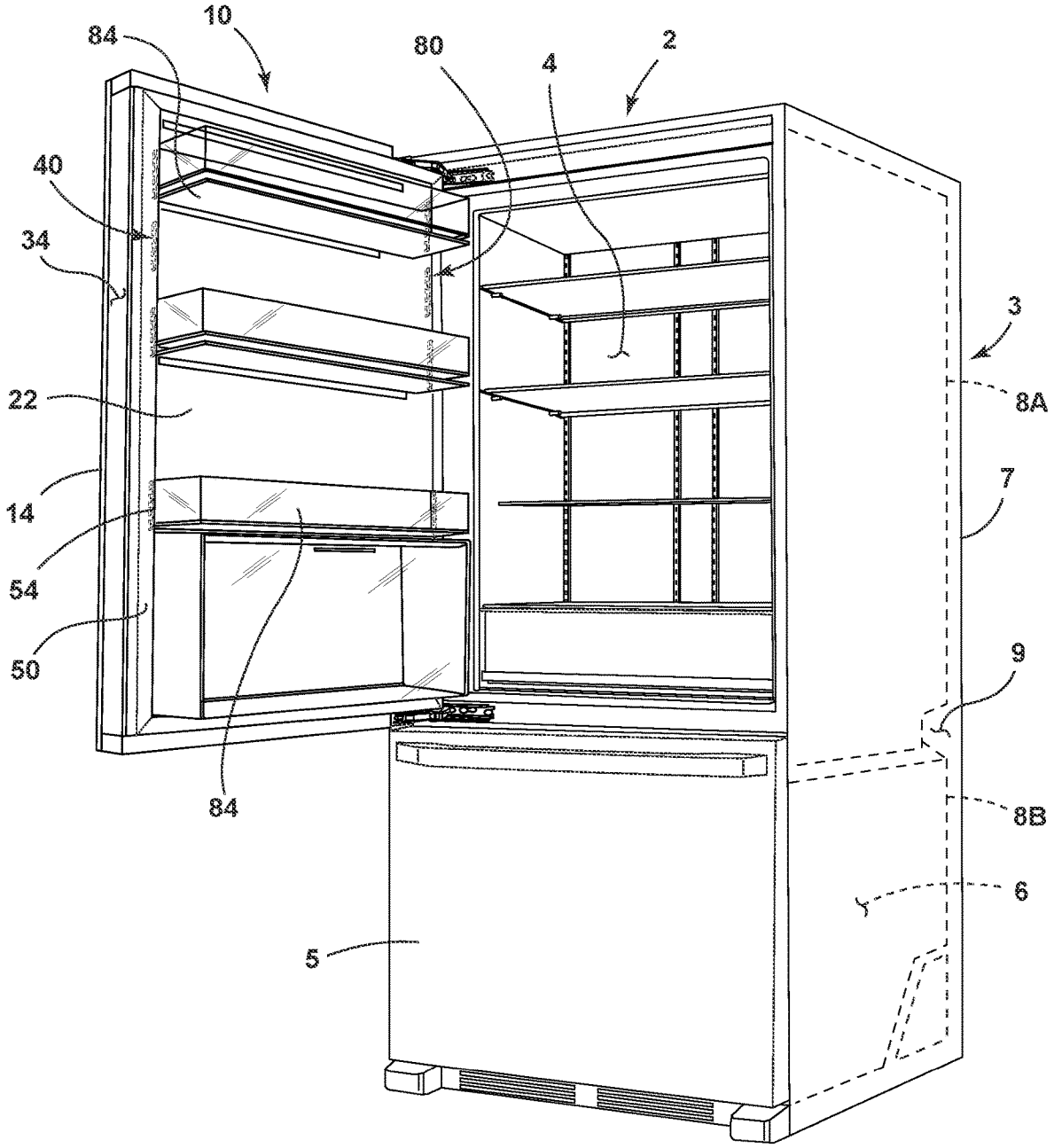
FIG. 1 is a front perspective view of an appliance having a door in an open position with a plurality of bins supported on a support system.

The components in the figures are not necessarily to scale, emphasis instead being placed upon illustrating the principles described herein.

DETAILED DESCRIPTION

The present illustrated embodiments reside primarily in combinations of method steps and apparatus components related to a door panel configured to support storage assemblies. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-3 and 8, reference numeral 10 generally designates door for a refrigerating appliance 2. The door 10 may include an outer panel 14 having a generally planar body portion 18 and an inner panel 22 having a generally planar body portion 26. A trim breaker 30 may interconnect the outer panel 14 and the inner panel 22 to form an insulation cavity 34 therebetween. The door 10 also includes at least one bracket assembly 40 coupled to an outer surface 44 of the inner panel 22, which may be inset from the trim breaker 30. The at least one bracket assembly 40 includes a plurality of receiving apertures 48. The door 10 further includes a trim shroud 50 that includes at least one elongate slot 54 disposed therethrough and positioned vertically therealong. The trim shroud 50 may be disposed over the at least one bracket assembly 40 and a portion of the trim breaker 30 that is at an interface 60 between the trim breaker 30 and the inner panel 22 such that the at least one elongate slot 54 of the trim shroud 50 is in alignment with at least one of the plurality of receiving apertures 48.

In some implementations, the door 10 is a vacuum insulated door, but the door 10 is not limited to such a configuration. Further, while the appliance 2 is illustrated as a refrigerator appliance, it is contemplated that the door 10 disclosed herein may be used with a variety of appliances, structures, or for insulation purposes other than those associated with a refrigerator appliance. Specifically, the illustrated appliance 2 is a bottom mount refrigerator having the door 10 and a second door 5. The second door 5 may include a same or different configuration as the door 10.

Turning now to FIG. 1, the appliance 2 includes a cabinet 3 that defines a first compartment 4 and a second compartment 6. The door 10 is contemplated to be rotatably coupled to the cabinet 3 for selectively providing access to the first compartment 4, which may be a refrigerator compartment. As illustrated, the second insulated door 5 is configured to be slidably coupled to the cabinet 3 in a drawer-like manner for selectively providing access to the second compartment 6, which may be a freezer compartment. The cabinet 3 of the appliance 2 is an insulated structure having a cabinet wrapper 7 with a first liner 8A and a second liner 8B positioned therein to define an insulating space 9 therebetween. In non-limiting examples, the appliance 2 can be a bottom mount refrigerator, a bottom mount French door refrigerator, a top mount refrigerator, a side-by-side refrigerator, a four-door French door refrigerator, and/or a five door French door refrigerator, each of which can have one or more insulated doors 10.

As noted above, the door 10 may be in the form of a vacuum insulated structure. As illustrated in FIGS. 1-5, the insulated door 10 includes the outer panel 14 coupled with the inner panel 22 to thereby define the insulation cavity 34 therebetween. The outer panel 14 and the inner panel 22 may optionally be referred to as a structural wrapper that defines the insulation cavity 34. The insulation cavity 34 of the door 10 and the insulating space 9 of the cabinet 3 typically include one or more insulation materials disposed therein. The insulation materials may substantially fill the insulation cavity 34 of the door 10, thereby forming a substantially continuous layer between the outer panel 14 and the inner panel 22 of the door 10. Similarly, the insulation materials may substantially fill the insulating space 9 of the cabinet 3, thereby forming a substantially continuous layer between the cabinet wrapper 7 and the first and second liners 8A, 8B.

As noted above, the appliance 2 includes two insulated doors 10, 5. In this way, first and second compartments 4, 6 defined by the cabinet 3 can each be sealed with an insulated door 10, 5, respectively. The outer panel 14 and the inner panel 22 of the doors 10, 5 may be made from a material at least partially resistant to bending, deformation, or otherwise being formed in response to an inward compressive force. These materials for the outer panel 12 and the inner panel 22 include, but are not limited to, metals, polymers, metal alloys, combinations thereof, and/or other similar substantially rigid materials that can be used for insulated structures, which may be in the form of vacuum insulated structures.

In implementations of the present disclosure where the door 10 is in the form of a vacuum insulated structure, a vacuum 70 (FIG. 5) is defined within the insulation cavity 34 of the door 10. The vacuum 70 defines a pressure differential between an exterior 74 or outside environment of the insulated door 10 and the insulation cavity 34 disposed within the door 10. The vacuum 70 is typically defined by evacuation of the insulated door 10 at an evacuation port which is later sealed after an evacuation procedure.

Referring again to FIG. 1, the door 10 is shown having a support system 80 for supporting storage assemblies, such as bin assemblies 84. Each bin assembly 84 is configured to couple to the support system 80 at a multitude of vertical locations along the support system 80, as further described below.

Figure 2:
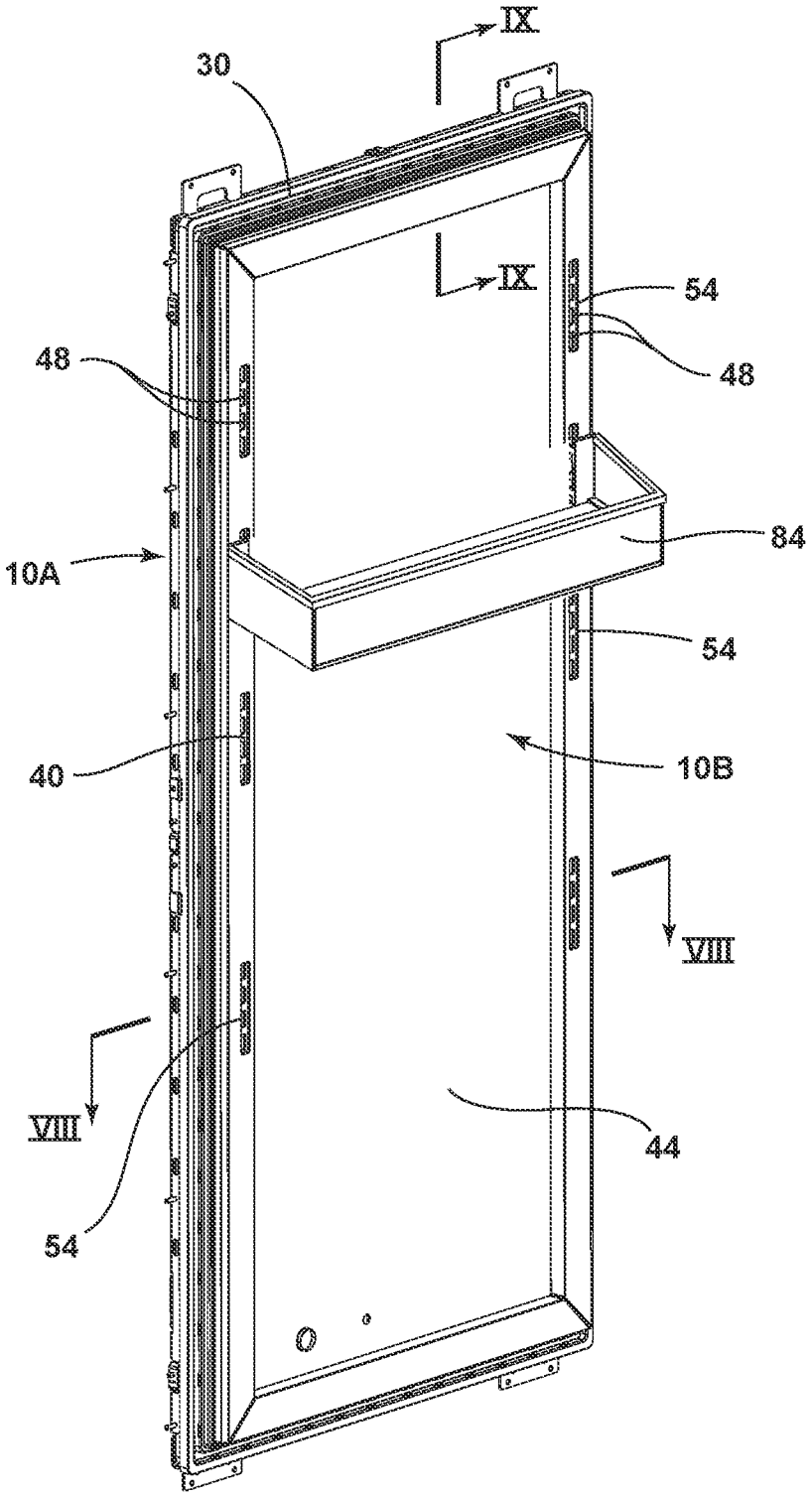
FIG. 2 is a top perspective view of the door of FIG. 1 as removed from the appliance with a bin assembly coupled thereto.

Referring now to FIG. 2, the support system 80 of the door 10 is shown having a single bin assembly 84 coupled thereto. As shown in FIG. 2, the door 10 includes an exterior side 10A and an interior side 10B. The support system 80 includes the at least one bracket assembly 40, which may be coupled to the outer surface 44 of the inner panel 22. As further shown in FIG. 2, the outer panel 14 and the inner panel 22 are interconnected by the trim breaker 30, to form the insulation cavity 34 therebetween. The trim breaker 30 is contemplated to be a polymeric member formed from a suitable material that includes a low coefficient of thermal conductivity to reduce or prevent transfer of heat between the outer panel 14 and the inner panel 22. For use with the present concept, the trim breaker 30 may be formed utilizing a polymeric material in an injection molding process. Other materials suitable to form the trim breaker 30 may include, but are not limited to, polyureas, polyisocyanurates, polyesters, polyphenols, polyepoxides, thermoplastic elastomers, polycarbonate, and nylon materials. It is further contemplated that the trim breaker 30 may be overmolded to the outer panel 14 and the inner panel 22 at perimeter edges thereof. In an overmolded construction, the door 10 can be a unitary part after the trim breaker 30 is cast onto the perimeter edges of the outer panel 14 and the inner panel 22. Further, it is contemplated that portions of the inner panel 22 and the outer panel 14 can be coupled to coupling features of the trim breaker 30 and retained therein using an adhesive as further described below.

Figure 3:
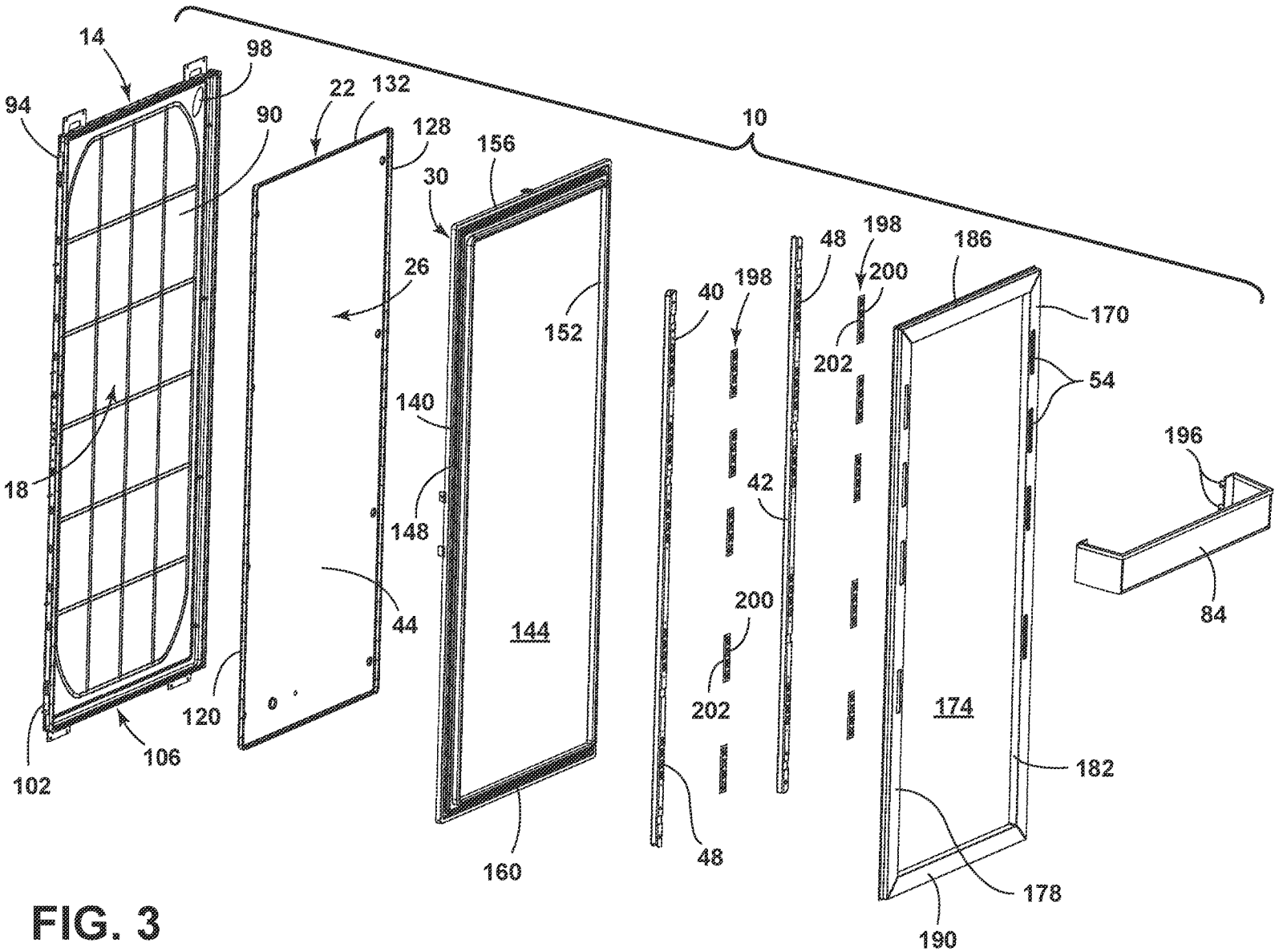
FIG. 3 is an exploded top perspective view of the door of FIG. 2.

Referring now to FIG. 3, an exploded view of the door 10 is shown, wherein the outer panel 14 and inner panel 22 are exploded away from the trim breaker 30 that interconnects the outer panel 14 and inner panel 22. As shown in FIG. 3, the outer panel 14 of the door 10 includes the generally planar body portion 18 with an inner surface 90 and an outer surface 94. The outer panel 14 may include an access aperture 98 disposed therethrough which can be used to fill the door 10 with an insulating material and may also be used as an evacuation port to draw a vacuum on the door 10, as described herein. The outer surface 94 of the body portion 18 of the outer panel 14 defines the exterior side 10A (FIG. 2) of the door 10 as assembled. As further shown in FIG. 3, the outer panel 12 includes a sidewall 102 extending outwardly from the generally planar body portion 18 of the outer panel 14 along a periphery 106 thereof. The sidewall 102 of the outer panel 14 includes a front edge 110 which is configured to be received in an outer channel 114 of the trim breaker 30, as further described below with reference to FIG. 8, to connect the outer panel 14 to the trim breaker 30.

As further shown in FIG. 3, the inner panel 22, like the outer panel 14, includes a generally planar body portion 26 having an inner surface 120 and the aforementioned outer surface 44. The outer surface 44 of the body portion 26 of the inner panel 22 defines the interior side 10B (FIG. 2) of the door 10 as assembled. The inner panel 14 further includes a sidewall 128 extending outwardly from the generally planar body portion 26 of the inner panel 22 along a periphery 132 thereof. The sidewall 128 of the inner panel 22 includes a front edge 136 which is configured to be received in an inner channel 138 of the trim breaker 30, as further described below with reference to FIG. 8, to connect the inner panel 22 to the trim breaker 30. The sidewalls 102, 128 of the outer and inner panels 14, 22, respectively, are contemplated to be disposed around the entire periphery 106, 132 of the body portions 18, 26 of the respective outer and inner panels 14, 22.

As further shown in FIG. 3, the trim breaker 30 is shown having a breaker frame assembly 140 surrounding an open window 144. The breaker frame assembly 140 of the trim breaker 30 is defined by first and second upright members 148, 152 which are spaced-apart from one another and interconnected by upper and lower cross members 156, 160. The first and second upright members 148, 152 and upper and lower cross members 156, 160 are interconnected, such that the trim breaker 30 is contemplated to be a unitary member.

Still referring to FIG. 3, the trim shroud 50 is shown having a trim frame assembly 170 surrounding an open window 174. The trim frame assembly 170 of the trim shroud 50 is defined by first and second vertical sections 178, 182, which are spaced-apart from one another and interconnected by first and second horizontal sections 186, 190, such that the trim shroud 50 is contemplated to be a unitary member. The trim shroud 50 includes the at least one elongate slot 54 disposed therethrough and positioned vertically therealong. In other words, the elongate slots 54 may be configured to run, in a vertical direction, at least a portion the entire length of first and second vertical sections 178, 182. More preferably, elongate slots 54 run a length that is more than 50% of the length of first and second vertical sections 178, 182.

As further shown in FIG. 3, the bin assembly 84 and first and second upright bracket assemblies 40, 42 are shown exploded away from the inner panel 22. The first and second bracket assemblies 40, 42 are contemplated to be metal components comprised of a metal material, such as steel, but is not limited to such a material. The first and second bracket assemblies 40, 42 run, in a vertical direction, at least a portion the entire length of first and second vertical sections 178, 182 of the trim shroud 50. In assembly, the first and second bracket assemblies 40, 42 are configured to couple to, or abut, the outer surface 44 of the inner panel 22 such that at least one of the plurality of receiving apertures 48 is at least partially aligned with one of the elongate slots 54 of the trim shroud 50. The bin assembly 84 includes a number of engagement members that are configured to engage the first and second bracket assemblies 40, 42 to support the bin assembly 84 at a multitude of vertical locations therealong. In some aspects, the engagement members are in the form of hook members 196 that are configured to insert into the receiving apertures 48 to selectively retain or hang the bin assembly 84 with support from the first and second bracket assemblies 40, 42 in a removable condition.

In some implementations, the door 10 may include a plurality of shims 198 disposed between the first and second bracket assemblies 40, 42 and the trim shroud 50. Each shim 198 may include openings 200 that align with the serially aligned receiving apertures 48 on the first and second bracket assemblies 40, 42. The openings 200 may be sized to correspond with the size of the receiving apertures 48. As illustrated, the shims 198 include a planar surface 202 which may be suitable for receiving adhesive thereon. Further, the shims 198 may be sized to generate a predetermined clearance between the first and second bracket assemblies 40, 42 and the trim shroud 50.

Figure 4:
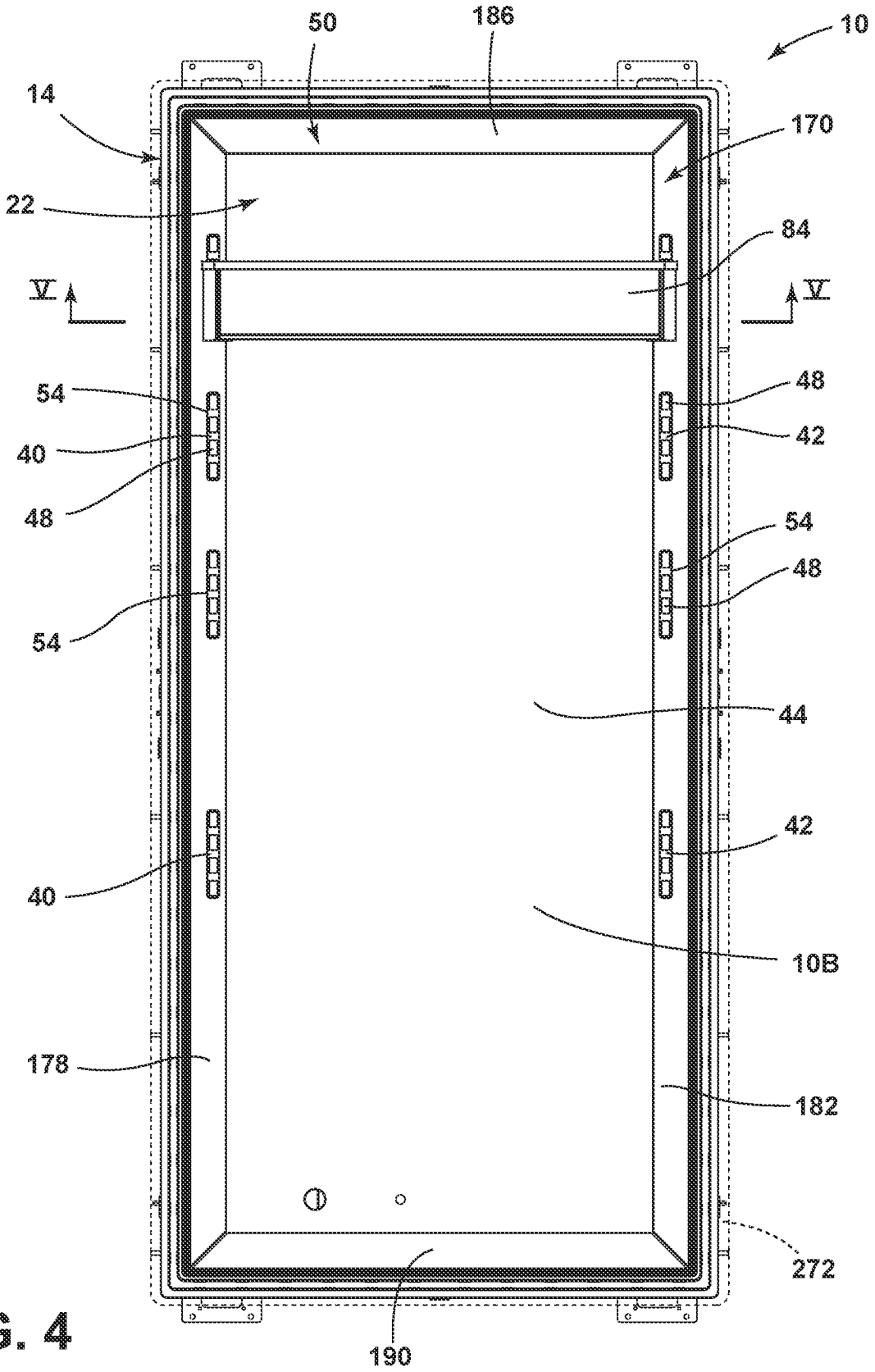
FIG. 4 is a front elevational view of the door of FIG. 2.

Referring now to FIG. 4, the door 10 of FIG. 3 is shown in an assembled condition from the interior side 10B thereof. As illustrated in FIG. 4, a plurality of the receiving apertures 48 of the first and second bracket assemblies 40, 42 are in alignment with and accessible via the elongate slots 54 of the trim shroud 50. Accordingly, bin assemblies 84 may be mounted to the door 10 at a variety of heights. Further as illustrated in FIG. 4, the first and second bracket assemblies 40, 42 and a portion of the trim breaker 30 are concealed or covered by the trim shroud 50, thereby providing an aesthetically pleasing appearance.

Figure 5:
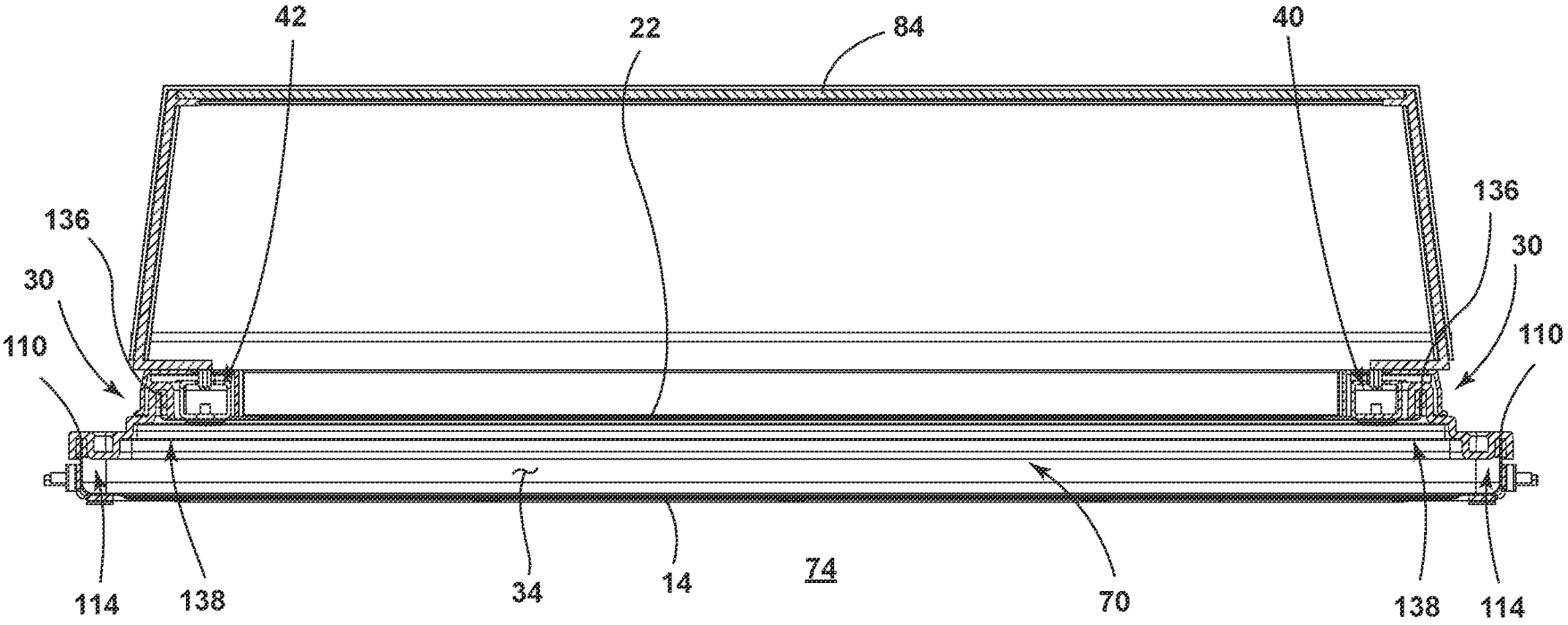
FIG. 5 is a cross-sectional view of the door of FIG. 4 taken at line V-V.
Figure 8:
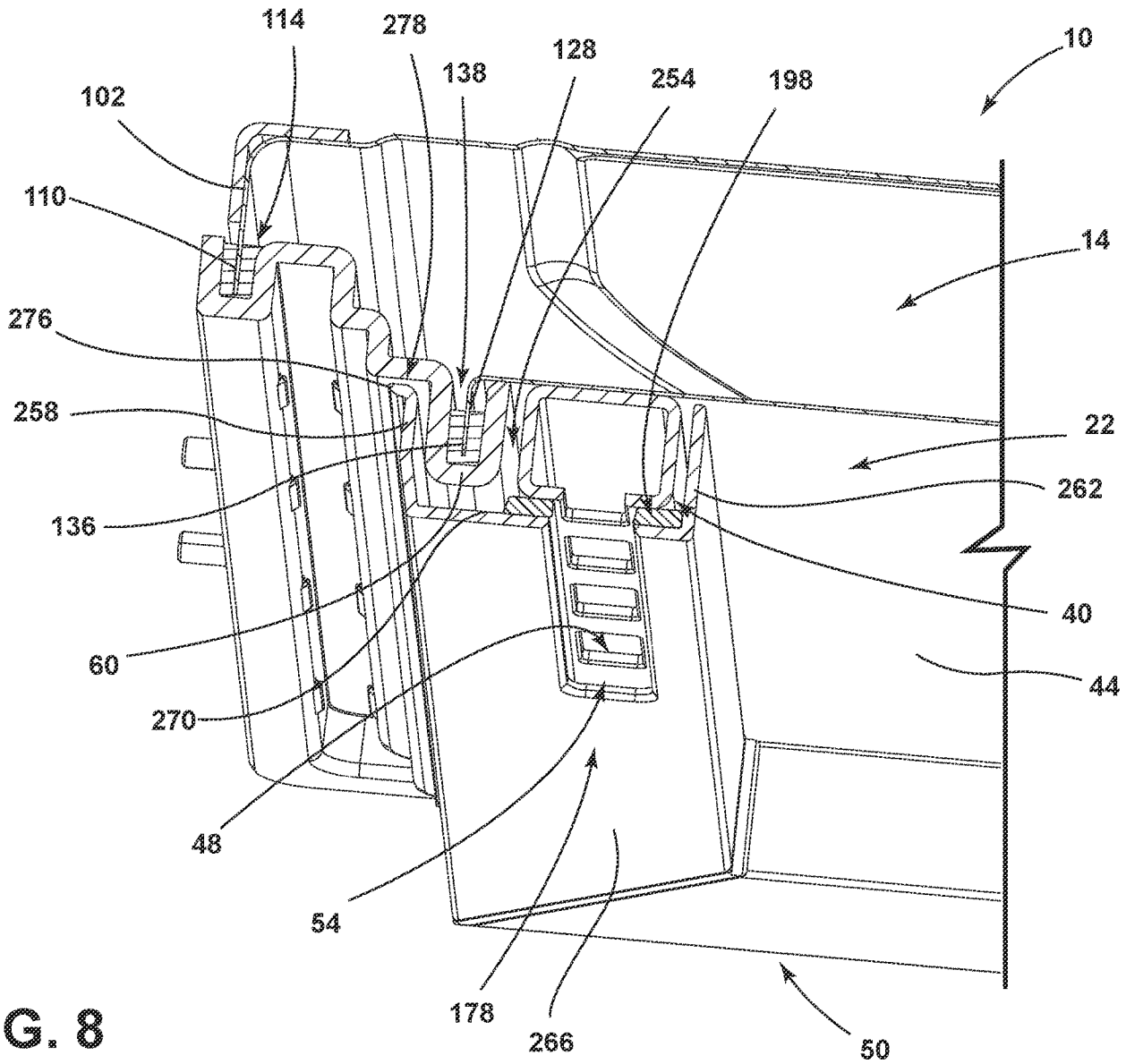
FIG. 8 is a fragmentary cross-sectional view of the door of FIG. 2 taken at line VIII-VIII.

Turning now to FIG. 5, the trim breaker 30 is shown having the inner channel 138 and the outer channel 114 spaced-apart from one another. Both the inner channel 138 and the outer channel 114 are forwardly opening channels that are configured to receive the front edges 110, 136 of the sidewalls 102, 128 of the outer panel 14 and the inner panel 22, respectively. The interconnection of the inner panel 22 with the inner channel 138 of the trim breaker 30 and the outer panel 14 with the outer channel 114 of the trim breaker is best shown in FIG. 8. The inner channel 138 and the outer channel 114 are contemplated to be continuously disposed around the entirety of the breaker frame assembly 140 of the trim breaker 30 along the first and second upright members 148, 152 and the upper and lower cross members 156, 160. In this way, the interconnection between trim breaker 30 and the inner panel 22 and outer panel 14 is complete around the entire breaker frame assembly 140 of the trim breaker 30 for providing the sealed insulation cavity 34 therebetween. As further shown in FIG. 5, the outer channel 114 surrounds the inner channel 138, such that the outer channel 114 is disposed outwardly around the inner channel 138. Specifically, the outer channel 114 is disposed adjacent to a perimeter of the trim breaker 30, while the inner channel 138 is inset from the perimeter of the trim breaker 30. Further, the outer channel 114 is disposed in forward position relative to the inner channel 138. Said differently, the inner channel 138 is inset from the outer channel 114 relative to the exterior side 10A of the door 10.

With the inner panel 22 and the outer panel 14 coupled to the trim breaker 30, as shown in FIG. 5, the sealed insulation cavity 34 is formed. The insulation cavity 34 is configured to receive an insulating material, which, in some implementations, may be described as a vacuum core material. The vacuum core material may comprise a plurality of individual core panels that are preformed and positioned between the outer panel 14, the inner panel 22 and the trim breaker 30. Alternatively, the vacuum core material may comprise a silica powder or other suitable loose filler or free-flowing material that is inserted (e.g., poured, blown, compacted) into the insulation cavity 34, after the outer panel 14 and the inner panel 22 are interconnected by the trim breaker 30. This free-flowing material can be in the form of various silica-based materials, such as fumed silica, precipitated silica, nano-sized, and/or micro-sized aerogel powder, rice husk ash powder, perlite, glass spheres, hollow glass spheres, cenospheres, diatomaceous earth, combinations thereof, and other similar insulating particulate material. The core material may be inserted into insulation cavity 34 through the access aperture 98 of the outer panel 14, which opens into the insulation cavity 34. The trim breaker 30 is contemplated to engage the outer panel 14 and the inner panel 22 in a sealed manner so as to create an airtight cavity within the insulation cavity 34. In this way, the door 10 is capable of having the vacuum 70 drawn within the insulation cavity 34 and maintaining the vacuum 70 given the sealed connections between the trim breaker 30, the outer panel 14 and the inner panel 22. Further, the vacuum 70 is maintained within the insulation cavity 34 of the door 10 in part by the sheet metal materials of the inner and outer panels 14, 12 and gas impervious polymeric materials of the trim breaker 30. The vacuum 70 may have a pressure level of less than 1 atm, about 0.5 atm, about 0.4 atm, about 0.3 atm, about 0.2 atm, about 0.1 atm, about 0.01 atm, or less than about 0.001 atm.

Figure 6:
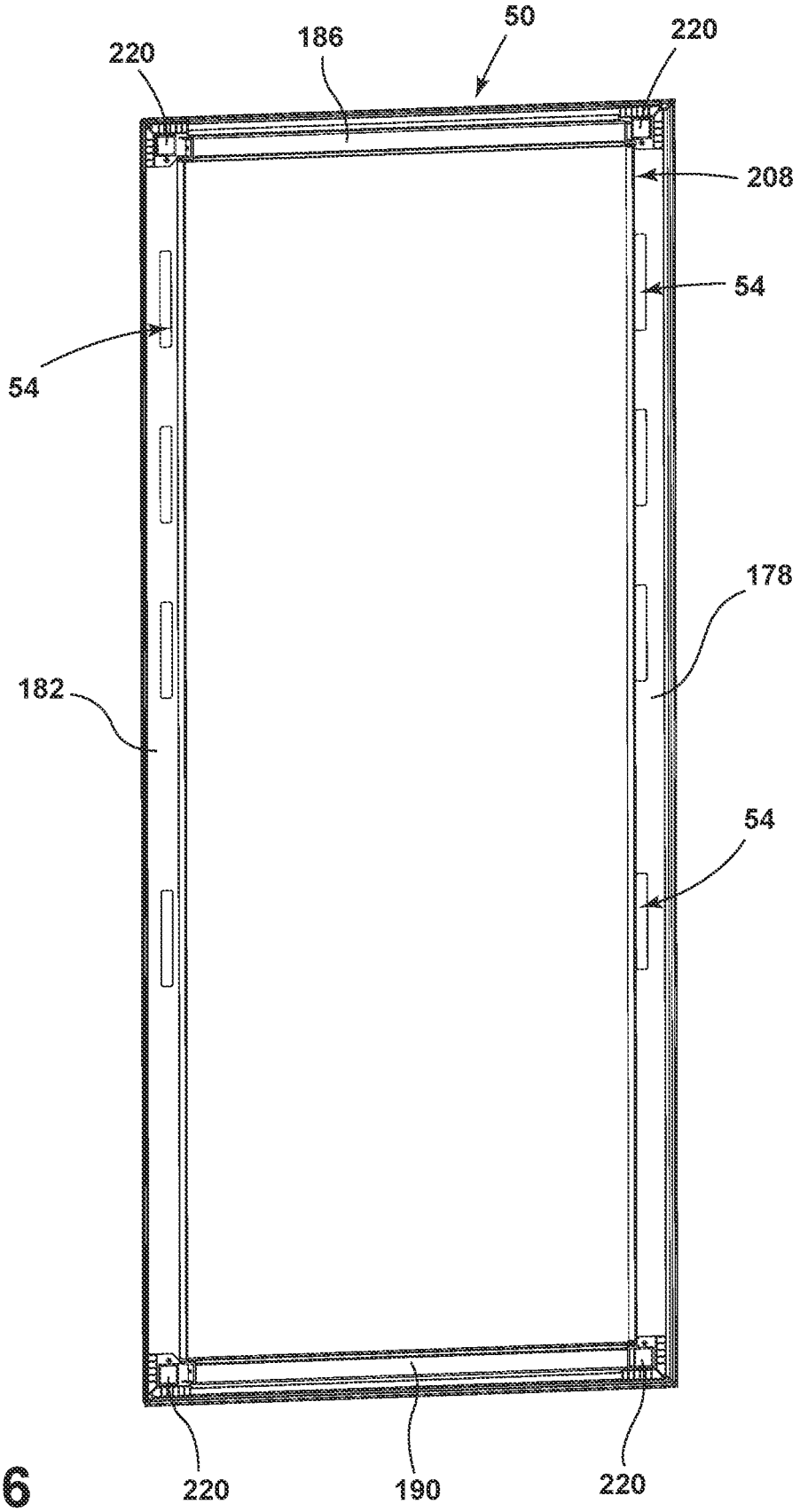
FIG. 6 is a rear elevational view of a trim shroud of the door of FIG. 2.

FIG. 6 illustrates a rear side 208 of the trim shroud 50. Again, it is contemplated that the trim shroud 50 is in the form of a unitary member. In some implementations, the first and second vertical sections 178, 182 and the first and second horizontal sections 186, 190 are formed as a single piece (e.g., via injection molding). Optionally, the first and second vertical sections 178, 182 and the first and second horizontal sections 186, 190 may each be formed as individual components (e.g., extruded parts with machined openings) and assembled to form the unitary member. As shown in FIG. 6, the first and second vertical sections 178, 182 and the first and second horizontal sections 186, 190 are interconnected using corner pieces 220. The illustrative corner pieces 220 are disposed in each corner of the trim shroud 50 and are configured to fix the trim shroud 50 in a unitary condition (e.g., as a unitary member). It is contemplated that, during assembly, a corner piece 220 is attached to one of the first and second vertical sections 178, 182, then one of the first and second horizontal sections 186, 190 is aligned with the corner piece, which continues until the trim shroud 50 is in a unitary condition.

Figure 7:
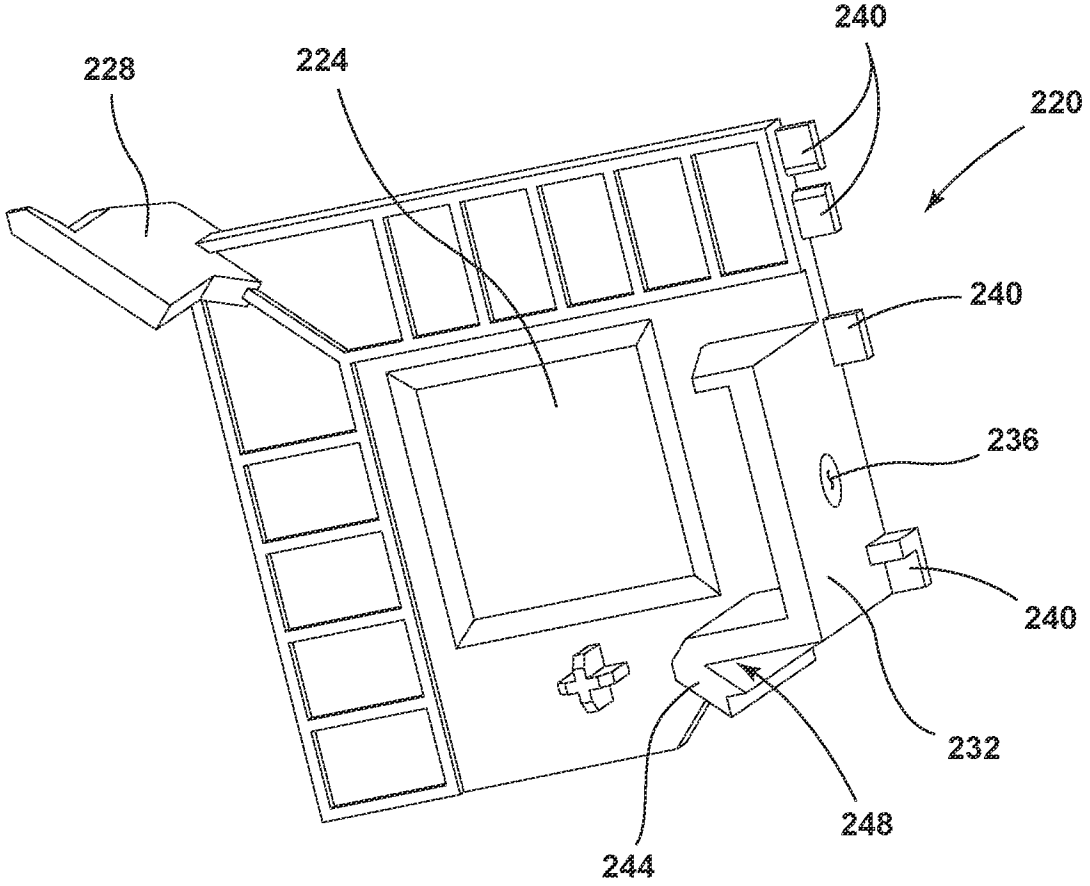
FIG. 7 is a front perspective view of a corner piece of the trim shroud of FIG. 6.

Turning to FIG. 7, one of the corner pieces 220 is shown in more detail. As illustrated, the corner piece 220 includes a body section 224 having an outer corner seal 228 and an inner corner mounting structure 232. The outer corner seal 228 may be angled (e.g., diagonally) to nestle between distal edges of the first and second vertical sections 178, 182 and the first and second horizontal sections 186, 190, respectively at the rear side 208 of the trim shroud 50 to create a fluid-tight alignment. The corner mounting structure 232 may include a bore hole 236 that is configured to receive a fastener (e.g., a screw) to couple the corner piece 220 to one of the first and second vertical sections 178, 182 and/or the first and second horizontal sections 186, 190. The corner mounting structure 232 may include an inner corner seal 244 that is configured to nestle between inner edges of the first and second vertical sections 178, 182 and the first and second horizontal sections 186, 190, respectively at the rear side 208 of the trim shroud 50 to create a fluid-tight alignment. As illustrated, the inner corner seal 244 as angled diagonally and defines a recess 248. The recess 248 defined by the inner corner seal 244 may be dimensioned to receive an inner edge of the first and second horizontal sections 186, 190. While illustrated as including a single corner mounting structure 232, it is possible that the corner pieces include two corning mounting structures 232, without departing from the scope of the disclosure. Additionally, the corner piece 220 may include tabs 240 to facilitate alignment with the first and second vertical sections 178, 182 and the first and second horizontal sections 186, 190. The trim shroud 50 and corner pieces 220 thereof may be made of any suitable material, including, but not limited to, metals, polymers, metal alloys, combinations thereof, and/or other similar substantially rigid materials.

Referring now to FIG. 8, door 10 is shown from a section view that shows the interconnection between the trim breaker 30 and the outer and inner panels 14, 22 at a side of the door 10 having the first vertical section 178 of the trim shroud 50. The first bracket assembly 40 is shown coupled to the outer surface 44 of the body portion 26 of the inner panel 22. As illustrated, receiving apertures 48 of the first bracket assembly 40 are in alignment with and accessible via the elongate slots 54 of the trim shroud 50. In other words, the first bracket assembly 40 is aligned with an elongate slot 54 of the first vertical section 178 such that a receiving aperture 48 is made accessible through the trim shroud 50. In implementations including the trim shrouds 198, the openings 200 align with the serially aligned receiving apertures 48 on the first bracket assembly 40, As such, a hook member of the hook members 196 (FIG. 3) of the bin assembly 84 received through the elongate slot 54 of the trim shroud 50 and further through the aligned opening 200 and receiving aperture 48 of the first bracket assembly 40.

Further, as illustrated in FIG. 8, the trim shroud 50 is disposed over the at least one bracket assembly 40 and a portion of the trim breaker 30 at the interface 60 that is between the trim breaker 30 and the inner panel 22, which may prevent a user from viewing the trim breaker 30 from the interior side 10B when the door 10 is in the assembled condition. In some aspects, the interface 60 defines the inner channel 138, which may be disposed within an interior 254 of the trim shroud 50. In some aspects, the trim shroud 50 includes a first sidewall 258 opposing a second sidewall 262, which are joined by a fascia 266. The fascia 266 is generally planar and defines the elongate slots 54 therethrough. Accordingly, an interior side 270 of the fascia 266 may be coupled (e.g., adhered via a suitable adhesive or fastener) to the shims 198, when present. Alternatively, the fascia 266 may be somewhat spaced from or in direct contact with the first and second bracket assemblies 40, 42. The first sidewall 258 may be adjacent to a portion of the trim breaker 30 at the interface 60. Optionally, a gasket 272 (shown in phantom in FIG. 4) may be disposed over a portion of the trim breaker 30 that forms the outer channel 114, adjacent to the trim shroud 50. In some implementations, the first sidewall 258 includes a bent edge 276 that is configured to contact a planar midsection 278 of the trim breaker 30. The second sidewall 262 may be adjacent to, or abut, the at least one bracket assembly 40.

Figure 9:
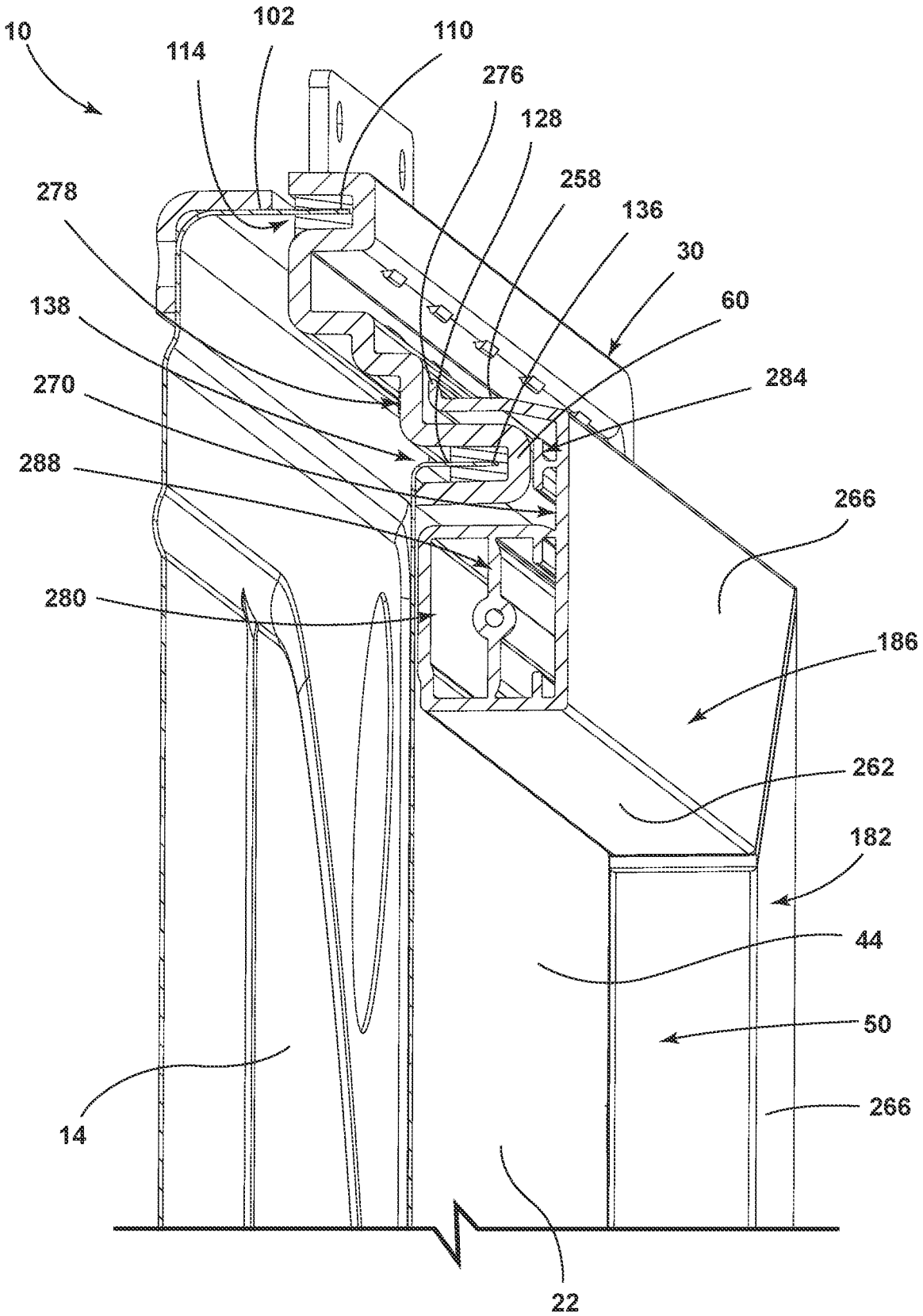
FIG. 9 is a fragmentary cross-sectional view of the door of FIG. 2 taken at line IX-IX.

Referring now to FIG. 9, the door 10 is shown from a section view that shows the interconnection between the trim breaker 30 and the outer and inner panels 14, 22, at an upper end of the door 10. As illustrated in FIG. 9, a geometric profile 280 of the first horizontal section 186 of the trim shroud 50 is shown, which may be the same as a geometric profile of the second horizontal section 190. In some implementations, the first and second horizontal sections 186, 190 are shaped to accommodate the lack of presence of a bracket assembly, while maintaining a consistent size and outward appearance with the first and second vertical sections 178, 182 of the trim shroud 50. In some aspects, the geometric profile 280 includes at least one of an extension strip 284 and a scaffolding 288. As illustrated, the extension strip 284 projects toward, and in some cases, onto, the interface 60. The scaffolding 288 may include any suitable framework structure to provide support for the trim shroud 50 in the otherwise vacant portion of the trim shroud 50. In this way, the trim shroud 50 at the first and second vertical sections 178, 182 may include clearance for the trim breaker 30. Optionally, the interior side 270 of the fascia 266 of the first and second vertical sections 178, 182 may be coupled (e.g., adhered via a suitable adhesive or fastener) to the inner panel 22. For example, a double-sided adhesive may be used to facilitate retention of the trim shroud 50 to the inner panel 22 at upper and lower ends thereof.

Figure 10:
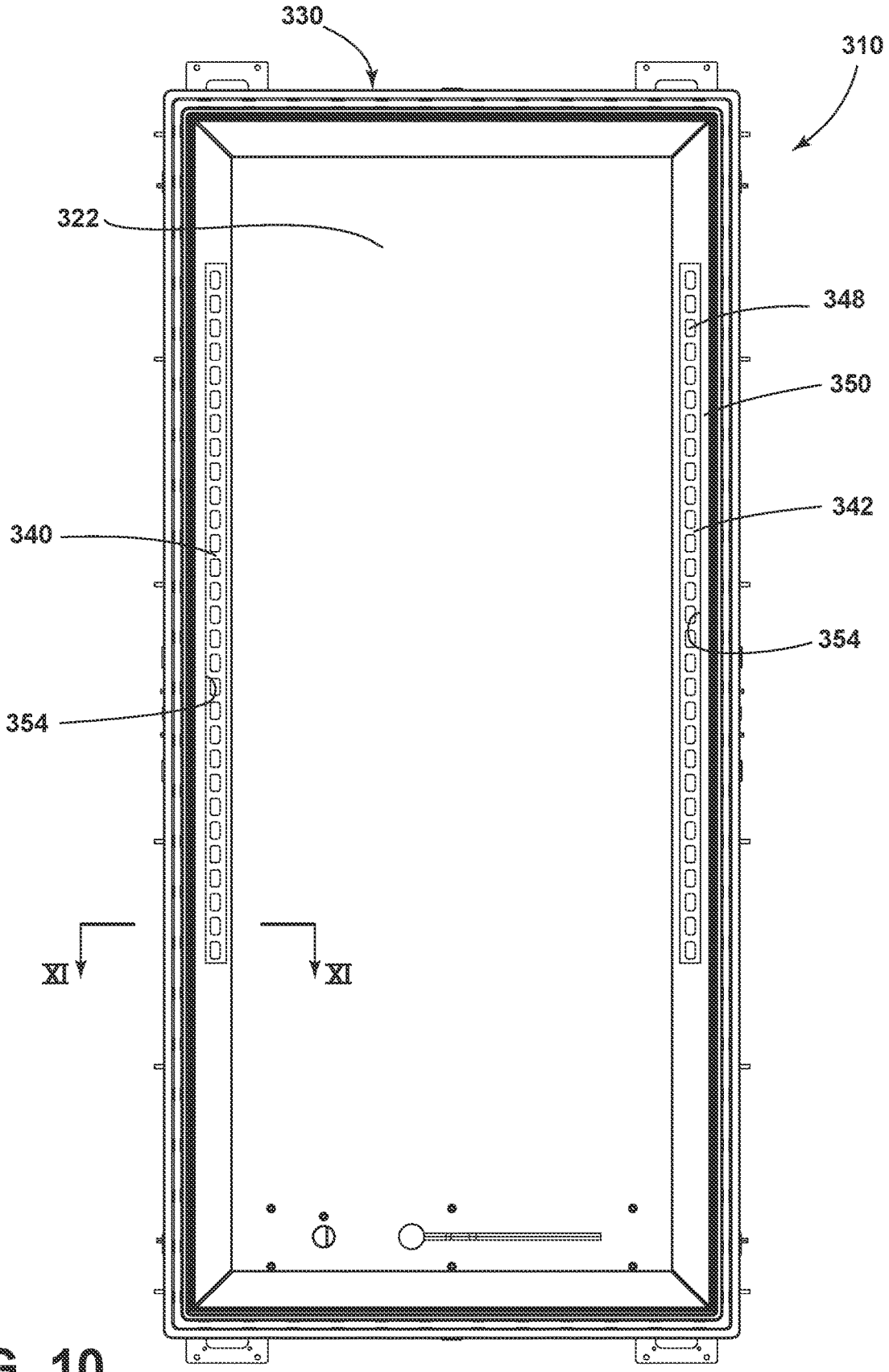
FIG. 10 is a front elevational view of another exemplary door as removed from the appliance.
Figure 11:
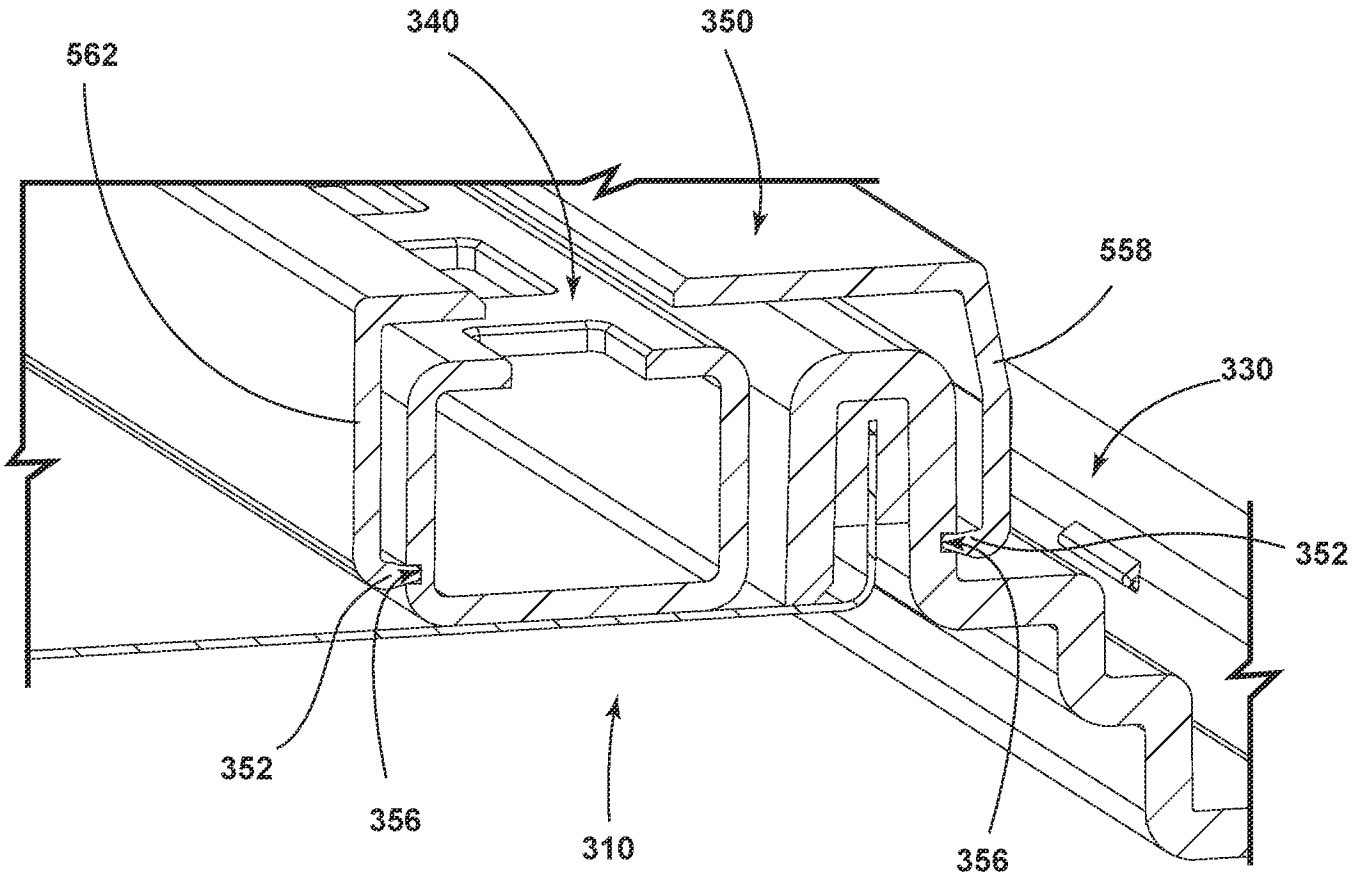
FIG. 11 is a fragmentary cross-sectional view of the door of FIG. 10 taken at line XI-XI.

Turning now to FIGS. 10 and 11, another exemplary embodiment door assembly 310 and trim shroud 350 is illustrated. The door assembly 310 and trim shroud 350 are substantially similar to the door 10 and the trim shroud 50. Therefore, like parts will be identified with like numerals increasing by 300, unless otherwise noted. Accordingly, the description with respect to the door 10 and the trim shroud 50 applies to the door 310 and the trim shroud 350, unless otherwise noted. One difference between the trim shroud 350 and the trim shroud 50 is that, in the trim shroud 350 first and second sidewalls 558, 562 are configured to snap into position on the at least one bracket assembly 340 and trim breaker 330. Specifically, the first sidewall 558 and the second sidewall 562 of the trim shroud 350 include projections 352 extending from distal edges thereof. The projections 352 may be in the form of bent edges that are configured to mate with corresponding recesses 356 defined on the at least one bracket assembly 340 and trim breaker 330. While illustrated as each of the at least one bracket assembly 340 and the trim breaker 330 having the recesses 356 in sides thereof, it is within the scope of the disclosure for only one of the at least one bracket assembly 340 and the trim breaker 330 to include the recesses 356 and the corresponding one of the first sidewall 558 and the second sidewall 562 of the trim shroud 350 to include the projection 352.

According to various examples, the insulated door 10 can be used in various appliances that can include, but are not limited to, refrigerators, freezers, coolers, ovens, dishwashers, laundry appliances, and other similar appliances and fixtures within household and commercial settings.

The device disclosed herein is further summarized in the following paragraphs and is further characterized by combinations of any and all of the various aspects described herein.

According to one aspect of the present disclosure, a door for a refrigerating appliance includes an outer panel having a generally planar body portion and an inner panel having a generally planar body portion. A trim breaker interconnects the outer panel and the inner panel to form an insulation cavity therebetween. At least one bracket assembly is coupled to an outer surface of the inner panel, inset from the trim breaker and includes a plurality of receiving apertures. A trim shroud includes at least one elongate slot disposed therethrough and positioned vertically therealong. The trim shroud is disposed over the at least one bracket assembly and a portion of the trim breaker at an interface between the trim breaker and the inner panel such that the at least one elongate slot of the trim shroud is in alignment with at least one of the plurality of receiving apertures.

According to another aspect of the present disclosure, the trim breaker further includes an inner channel and an outer channel spaced-apart from one another around the trim breaker, further wherein a front edge of the inner panel is received in the inner channel of the trim breaker and a front edge of the outer panel is received in the outer channel of the trim breaker.

According to yet another aspect of the present disclosure, a portion of the trim breaker defines the inner channel and is disposed within an interior of the trim shroud.

According to another aspect of the present disclosure, the trim shroud includes a first sidewall opposing a second sidewall, which are joined by a fascia.

According to yet another aspect of the present disclosure, the first sidewall is adjacent to trim breaker and a vertical portion of the second sidewall is adjacent to the at least one bracket assembly.

According to another aspect of the present disclosure, the first sidewall includes a bent edge, further wherein the bent edge is configured to contact a planar midsection of the trim breaker.

According to yet another aspect of the present disclosure, the trim shroud defines a first vertical section opposing a second vertical section and a first horizontal section opposing a second horizontal section, further wherein the first and second horizontal sections interconnect the first and second vertical sections.

According to another aspect of the present disclosure, the first and second horizontal sections include at least one of an extension strip and a scaffolding.

According to yet another aspect of the present disclosure, corner pieces are configured to fix the trim shroud in a unitary condition.

According to another aspect of the present disclosure, the at least one elongate slot of the trim shroud is in alignment with more than one of the plurality of receiving apertures.

According to yet another aspect of the present disclosure, a door assembly includes an outer panel having a generally planar body portion and an inner panel having a generally planar body portion. A trim breaker interconnects the outer panel and the inner panel to form an insulation cavity therebetween. A pair of bracket assemblies are coupled to the inner panel, inset from the trim breaker and include a plurality of receiving apertures. A trim shroud defines a pair of elongate slots therethrough. The trim shroud is positioned to conceal the pair of bracket assemblies and a portion of the trim breaker at an interface between the trim breaker and the inner panel, wherein each of the pair of the elongate slots are at least partially aligned with at least one of the plurality of receiving apertures. A storage assembly is removably coupled to the pair of bracket assemblies through the pair of elongate slots.

According to another aspect of the present disclosure, the trim shroud includes a first sidewall opposing a second sidewall, which are joined by a fascia.

According to yet another aspect of the present disclosure, the first sidewall is adjacent the trim breaker and a vertical portion of the second sidewall is adjacent a bracket assembly of the pair of bracket assemblies.

According to another aspect of the present disclosure, the trim shroud defines a first vertical section opposing a second vertical section and a first horizontal section opposing a second horizontal section, the first and second horizontal sections interconnecting the first and second vertical sections, further wherein the first and second horizontal sections include a first cross-sectional profile and the first and second vertical sections include a second cross-sectional profile, the second cross-sectional profile defining a greater clearance than the first cross-sectional profile.

According to yet another aspect of the present disclosure, a refrigerating appliance includes a cabinet defining a compartment and a door that provides selective access to the compartment. The door includes an outer panel having a generally planar body portion and an inner panel having a generally planar body portion. A trim breaker interconnects the outer panel and the inner panel to form an insulation cavity therebetween. A first bracket assembly is coupled to the inner panel, inset from the trim breaker and includes a first plurality of receiving apertures. A second bracket assembly is coupled to the inner panel, inset from the trim breaker and includes a second plurality of receiving apertures. A trim shroud includes a first sidewall, a second sidewall parallel to the first sidewall, and a fascia joining the first sidewall and the second sidewall. The fascia defines a first slot and a second slot therethrough. The trim shroud is disposed over the first and second bracket assemblies and a portion of the trim breaker at an interface between the trim breaker and the inner panel such that each of the first and second slots are at least partially aligned with at least one of the first and second plurality of receiving apertures, respectively.

According to another aspect of the present disclosure, a storage assembly removably coupled to the first and second bracket assemblies through the first and second slots.

According to yet another aspect of the present disclosure, the storage assembly includes at least one hook member rearwardly extending therefrom, and further wherein the at least one hook member is at least partially received in a receiving aperture of the first and second receiving apertures.

According to another aspect of the present disclosure, the first sidewall is adjacent the trim breaker and the second sidewall is adjacent one of the first and second bracket assemblies.

According to yet another aspect of the present disclosure, the trim shroud defines first and second vertical sections and first and second horizontal sections, the first and second horizontal sections interconnecting the first and second vertical sections, further wherein the first and second vertical sections include a greater clearance than the first and second horizontal sections.

According to another aspect of the present disclosure, a portion of the trim breaker that defines an inner channel is disposed within an interior of the trim shroud.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A door for a refrigerating appliance, comprising:

an outer panel having a generally planar body portion;

an inner panel having a generally planar body portion;

a trim breaker interconnecting the outer panel and the inner panel to form an insulation cavity therebetween;

at least one bracket assembly coupled to an outer surface of the inner panel, inset from the trim breaker and including a plurality of receiving apertures; and a trim shroud that includes at least one elongate slot disposed therethrough and positioned vertically therealong, wherein the trim shroud is disposed over the at least one bracket assembly and a portion of the trim breaker at an interface between the trim breaker and the inner panel such that the at least one elongate slot of the trim shroud is in alignment with at least one of the plurality of receiving apertures.

2. The door of claim 1, wherein the trim breaker further includes an inner channel and an outer channel spaced-apart from one another around the trim breaker, and further wherein a front edge of the inner panel is received in the inner channel of the trim breaker and a front edge of the outer panel is received in the outer channel of the trim breaker.

3. The door of claim 2, wherein a portion of the trim breaker that defines the inner channel is disposed within an interior of the trim shroud.

4. The door of claim 1, wherein the trim shroud includes a first sidewall opposing a second sidewall, wherein the first sidewall and second sidewall are joined by a fascia.

5. The door of claim 4, wherein the first sidewall is adjacent the trim breaker and a vertical portion of the second sidewall is adjacent the at least one bracket assembly.

6. The door of claim 4, wherein the first sidewall includes a bent edge, and wherein the bent edge is configured to contact a planar midsection of the trim breaker.

7. The door of claim 6, wherein the trim shroud defines a first vertical section opposing a second vertical section and a first horizontal section opposing a second horizontal section, and wherein the first and second horizontal sections interconnect the first and second vertical sections.

8. The door of claim 7, wherein the first and second horizontal sections include at least one of an extension strip and a scaffolding.

9. The door of claim 1, wherein corner pieces are configured to fix the trim shroud in a unitary condition.

10. The door of claim 1, wherein the at least one elongate slot of the trim shroud is in alignment with more than one of the plurality of receiving apertures.

11. A door assembly, comprising:

an outer panel having a generally planar body portion;

an inner panel having a generally planar body portion;

a trim breaker interconnecting the outer panel and the inner panel to form an insulation cavity therebetween;

a pair of bracket assemblies coupled to an outer surface of the inner panel, inset from the trim breaker and including a plurality of receiving apertures;

a trim shroud that defines a pair of elongate slots therethrough, the trim shroud positioned to conceal the pair of bracket assemblies and a portion of the trim breaker at an interface between trim breaker and the inner panel, wherein each of the pair of the elongate slots are at least partially aligned with at least one of the plurality of receiving apertures; and a storage assembly removably coupled to the pair of bracket assemblies through the pair of elongate slots.

12. The door assembly of claim 11, wherein the trim shroud includes a first sidewall opposing a second sidewall, wherein the first sidewall and the second sidewall are joined by a fascia.

13. The door assembly of claim 12, wherein the first sidewall is adjacent the trim breaker and a vertical portion of the second sidewall is adjacent a bracket assembly of the pair of bracket assemblies.

14. The door assembly of claim 11, wherein the trim shroud defines a first vertical section opposing a second vertical section and a first horizontal section opposing a second horizontal section, the first and second horizontal sections interconnecting the first and second vertical sections, and further wherein the first and second horizontal sections include a first cross-sectional profile and the first and second vertical sections include a second cross-sectional profile, the second cross-sectional profile defining a greater clearance than the first cross-sectional profile.

15. A refrigerating appliance, comprising:

a cabinet defining a compartment; and a door that provides selective access to the compartment, the door comprising:

an outer panel having a generally planar body portion;

an inner panel having a generally planar body portion;

a trim breaker interconnecting the outer panel and the inner panel to form an insulation cavity therebetween;

a first bracket assembly coupled to the inner panel, inset from the trim breaker and including a first plurality of receiving apertures;

a second bracket assembly coupled to the inner panel, inset from the trim breaker and including a second plurality of receiving apertures; and a trim shroud, comprising:

a first sidewall;

a second sidewall parallel to the first sidewall; and a fascia joining the first sidewall and the second sidewall, the fascia defining a first slot and a second slot therethrough;

wherein the trim shroud is disposed over the first and second bracket assemblies and a portion of the trim breaker at an interface between trim breaker and the inner panel such that each of the first and second slots are at least partially aligned with at least one of the first and second plurality of receiving apertures, respectively.

16. The refrigerating appliance of claim 15, further comprising:

a storage assembly removably coupled to the first and second bracket assemblies through the first and second slots.

17. The refrigerating appliance of claim 16, wherein the storage assembly includes at least one hook member rearwardly extending therefrom, and further wherein the at least one hook member is at least partially received in a receiving aperture of the first and second receiving apertures.

18. The refrigerating appliance of claim 15, wherein the first sidewall is adjacent the visible portion of the trim breaker and the second sidewall is adjacent one of the first and second bracket assemblies.

19. The refrigerating appliance of claim 15, wherein the trim shroud defines first and second vertical sections and first and second horizontal sections, the first and second horizontal sections interconnecting the first and second vertical sections.

20. The refrigerating appliance of claim 15, wherein a portion of the trim breaker that defines an inner channel is disposed within an interior of the trim shroud.

* * * * *